US010192703B2

(12) United States Patent
Breder et al.

(10) Patent No.: US 10,192,703 B2
(45) Date of Patent: Jan. 29, 2019

(54) BYPASS SWITCH COMPRISING A PLUNGER, A FIRST CONTACT DEVICE AND A SECOND CONTACT DEVICE

(71) Applicant: ABB SCHWEIZ AG, Baden (CH)

(72) Inventors: Henrik Breder, Västerås (SE); Ola Jeppsson, Västerås (SE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/555,361

(22) PCT Filed: Apr. 24, 2015

(86) PCT No.: PCT/EP2015/058867
§ 371 (c)(1),
(2) Date: Sep. 1, 2017

(87) PCT Pub. No.: WO2016/169607
PCT Pub. Date: Oct. 27, 2016

(65) Prior Publication Data

US 2018/0350546 A1 Dec. 6, 2018

(51) Int. Cl.

| | |
|---|---|
| ***H01H 13/12*** | (2006.01) |
| ***H01H 33/28*** | (2006.01) |
| ***H01H 79/00*** | (2006.01) |
| ***H01H 3/16*** | (2006.01) |
| *H01H 9/30* | (2006.01) |

(52) U.S. Cl.
CPC ..... *H01H 79/00* (2013.01); *H01H 3/166* (2013.01); *H01H 13/12* (2013.01); *H01H 33/285* (2013.01); *H01H 9/30* (2013.01)

(58) Field of Classification Search
CPC ..... H01H 79/00; H01H 33/285; H01H 13/00; H01H 13/12
USPC ..... 361/13
See application file for complete search history.

(56) References Cited

U.S. PATENT DOCUMENTS 3,500,279 A * 3/1970 Malaspina ..... H01H 39/004 102/202.7
4,316,065 A 2/1982 Rupp et al.

FOREIGN PATENT DOCUMENTS

DE 23 38 637 A1 2/1975
DE 25 54 009 A1 9/1976
DE 27 55 322 A1 6/1979
(Continued)

OTHER PUBLICATIONS

International Preliminary Report on Patentability, issued in PCT/EP2015/058867, dated Apr. 24, 2017.
(Continued)

*Primary Examiner* — Dharti H Patel
(74) *Attorney, Agent, or Firm* — Birch, Stewart, Kolasch & Birch, LLP

(57) ABSTRACT

A bypass switch provides a bypass path between a first terminal and a second terminal. The bypass switch includes: a first contact device; a second contact device; and a plunger being moveable from an initial state, via a first state, to a second state, wherein in the initial state the first terminal and second terminal are conductively separated; in the first state a movement of the plunger causes the first contact device to close a first conductive connection between the first terminal and the second terminal; and in the second state the plunger mechanically forces the second contact device to close a second conductive connection between the first terminal and the second terminal.

20 Claims, 3 Drawing Sheets

(56) References Cited

FOREIGN PATENT DOCUMENTS

| | | | |
|---|---|---|---|
| DE | 31 39 489 | A1 | 7/1983 |
| DE | 195 24 636 | C1 | 9/1996 |
| EP | WO 00/67271 | A1 | 11/2000 |
| EP | 1 192 630 | A1 | 4/2002 |
| WO | WO 2013/143620 | A1 | 10/2013 |
| WO | WO 2013/185815 | A1 | 12/2013 |

OTHER PUBLICATIONS

International Search Report, issued in PCT/EP2015/058867, dated Jan. 15, 2016.

Müller et al., "Ein Kurzschliesser Fuer Hochspannungs-Schaltanlagen Mit Feststoffantrieb", Elektrie, Veb Verlag Technik. Berlin, DD, Jan. 1, 1993, vol. 47, No. 3, XP000359817, ISSN: 0013-5399, Figure 6.

Written Opinion of the International Searching Authority, issued in PCT/EP2015/058867, dated Jan. 15, 2016.

* cited by examiner

BYPASS SWITCH COMPRISING A PLUNGER, A FIRST CONTACT DEVICE AND A SECOND CONTACT DEVICE

TECHNICAL FIELD

The invention relates to a bypass switch, a power system and a method for providing a conductive path between a first terminal and a second terminal.

BACKGROUND

Power systems such as electrical power distribution or transmission systems are used for supplying, transmitting and using electric power. High Voltage Direct Current (HVDC) power transmission are becoming more prevalent due to increasing need for power transmission with low transmission loss and flexible interconnection possibilities.

Power systems such as electrical power transmission systems generally include a protection system for protecting, monitoring and controlling the operation of electrical devices in the power system. Such protection systems may for example be able to detect short circuits, overcurrents and overvoltages in power lines, transformers and/or other parts or components of the power system. The protection systems can include protection equipment such as circuit breakers for isolating any possible faults for example occurring in power transmission and distribution lines by opening or tripping the circuit breakers. After the fault has been cleared, e.g. by performing repairs and/or maintenance on the component in which the fault has been detected, the power flow can be restored by closing the circuit breakers.

Moreover the protection system can be arranged to, upon detection of a fault in a particular electrical device, isolate the faulty electrical device by bypassing the electrical device, using a bypass switch. The bypass switch then provides a conductive path to bypass the electrical device until the electrical device is repaired or replaced.

An HVDC converter station converts high voltage direct current (DC) to alternating current (AC) or vice versa. An HVDC converter station may comprise a plurality of elements such as a converter device (or a plurality of converters devices connected in series or in parallel), an AC switchgear, transformers, capacitors, filters, a DC switchgear and/or other auxiliary elements. Converter devices may comprise a plurality of solid-state based devices such as semiconductor devices and may be categorized as line-commutated converters, using e.g. thyristors as switches, or voltage source converters, using transistors such as insulated gate bipolar transistors (IGBTs) as switches. A plurality of solid-state semiconductor devices such as thyristors or IGBTs may be connected together, for instance in series, to form a building block, or cell, of an HVDC converter, which may also be referred to as an HVDC converter valve.

According to one example, a plurality of solid-state semiconductor devices such as thyristors or IGBTs may be connected in series in a cell of an HVDC converter. During normal operation of e.g. an HVDC power transmission system or an HVDC grid including the HVDC converter, the solid-state semiconductor devices in the HVDC converter may at times be in a conducting mode in which they are conducting current and at other times be in a blocking mode, in order to attain a desired (e.g. sinusoidal) waveform of the current. This may expose the solid-state semiconductor devices to continuous current stresses, which, especially in HVDC applications, may be of significant magnitude. If any one of the solid-state semiconductor devices fails, the current through the HVDC converter can be interrupted, and repairs and/or replacement of any failed solid-state semiconductor device might then become necessary in order to put the HVDC converter back into operation. In an HVDC converter station based on voltage source converters there may be DC capacitors, or DC capacitor banks, which act as voltage sources and which are connected to, for instance in parallel, one or several solid-state semiconductor devices such as IGBTs included in a cell of an HVDC converter.

As described above, upon detection of a fault in a particular electrical device, the faulty electrical device can be isolated by bypassing the electrical device, using a bypass switch. Such fault operation can be applied for faulty semiconductors and/or capacitor banks. However, due to the high voltages involved, arcing occurs during the switching, which deteriorates the contacts of the bypass switch, resulting in losses and/or an unstable bypass state.

It is desired to provide a bypass switch which reduces the ill-effects due to arcing.

SUMMARY

According to a first aspect, it is presented a bypass switch for providing a bypass path between a first terminal and a second terminal. The bypass switch comprises: a first contact device; a second contact device; and a plunger being moveable from an initial state, via a first state, to a second state, wherein in the initial state the first terminal and second terminal are conductively separated; in the first state a movement of the plunger causes the first contact device to close a first conductive connection between the first terminal and the second terminal; and in the second state the plunger mechanically forces the second contact device to close a second conductive connection between the first terminal and the second terminal.

The plunger may be displaceable along a first direction to transition from the initial state, via the first state, to the second state.

The second contact device may be located, in the first direction, in front of the first contact device.

The plunger may comprise a front section and a back section, wherein the front section is detachably connected to the back section, and wherein, in the first state, it is the back section which causes the first contact device to close the first conductive connection.

The second contact device may comprise a plurality of prongs which are forcible radially outwards by the plunger to close the second conductive connection.

The first contact device may be pivotable from a non-conductive state to a conductive state, when forced by the plunger.

The first contact device may comprise a conductive ball which is displaceable to cause a transition of the first contact device from a non-conductive state to a conductive state, when forced by the plunger.

The first contact device may be attached to the plunger in the initial state.

The bypass switch may further comprise a pyrotechnic device which, when fired, produces a shock wave to move the plunger from the initial state, via the first state to the second state.

The bypass switch may further comprise a spring which, when released causes the plunger to move from the initial state, via the first state to the second state.

During transition from the initial state via the first state to the second state, the movement of the plunger may be sufficiently slow such that energy transferred over the first conductive connection during the first state prevents arcing to the second contact device when the second state is assumed.

The plunger may be electrically insulating.

According to a second aspect, it is presented a power system comprising: an electrical device; and the bypass switch according to any one of the preceding claims. The first terminal and the second terminal of the bypass switch, are then connected across the electrical device.

According to a third aspect, it is presented a method for providing a conductive path between a first terminal and a second terminal. The method i performed in a bypass switch comprising a first contact device; a second contact device; and a plunger. The method comprises the steps of: moving the plunger from an initial state to a first state wherein in the initial state the first terminal and second terminal are conductively separated, and in the first state the plunger causes the first contact device to close a first conductive connection between the first terminal and the second terminal; and moving the plunger from the first state to a second state, wherein in the second state the plunger mechanically forces the second contact device to close a second conductive connection between the first terminal and the second terminal.

The method may further comprise the step of: detecting a fault in an electrical device connected across the first terminal and the second terminal.

The steps of moving from the initial state to the first state and moving from the first state to the second state may be performed as a result of a continuous movement of the plunger.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1A:
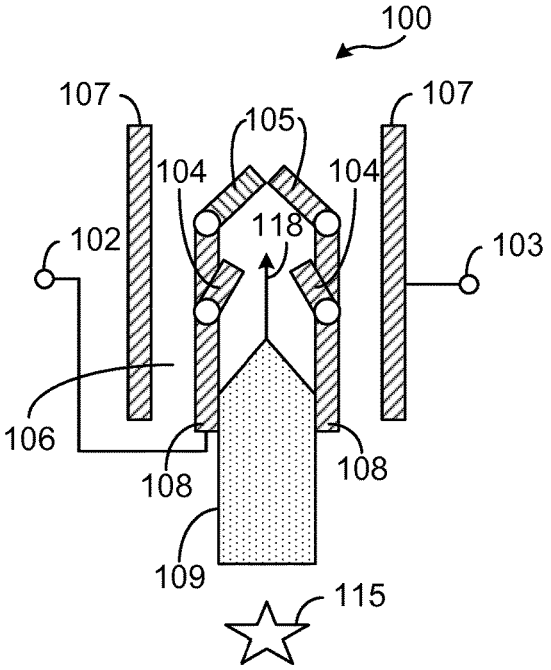
FIGS. 1A-C are schematic diagrams illustrating various states of a bypass switch according to one embodiment.
Figure 1B:
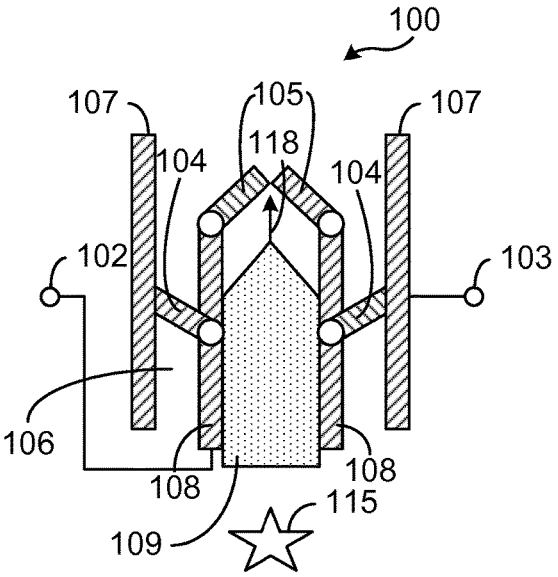
Figure 1C:
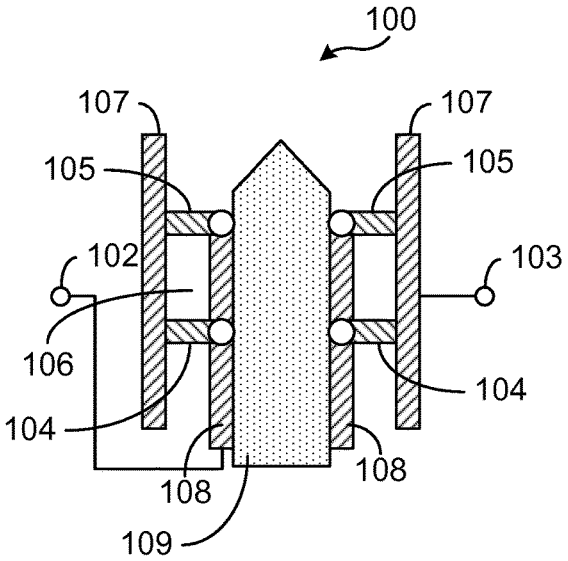

FIGS. 1A-C are schematic diagrams illustrating various states of a bypass switch too according to one embodiment. FIG. 1A illustrates an initial state, FIG. 1B illustrates a first state and FIG. 1C illustrates a second state of the bypass switch too. The figures represent a sectional view through the bypass switch too. The bypass switch too can e.g. be of an annular structure.

The bypass switch too is used for providing a bypass path between a first terminal 102 and a second terminal 103. The bypass path is a conductive path allowing an electrical current to flow between the first terminal 102 and the second terminal 103, either unidirectionally in either direction or bidirectionally.

An outer conductor 107 is made of conductive material, such as metal. The sections of the outer conductor 107 shown at the left and right side, respectively, may form part of a single outer conductor 107, or are at least conductively connected. When being a single section, the outer conductor 107 may e.g. be annular.

An inner conductor 108 is made of conductive material, such as metal. The sections of the inner conductor 108 shown at the left and right side, to respectively, may form part of a single inner conductor 108, or are at least conductively connected. When being a single section, the inner conductor 108 may e.g. be annular.

The inner conductor 108 is connected to a first terminal 102 and the outer conductor 107 is connected to a second terminal 103 (or vice versa).

One or more first contact devices 104 (of which two are seen) are arranged such that a plunger 109 can force them to close a first conductive connection between the inner connector 108 and the outer connector 107, and thus between the first terminal 102 and the second terminal 103.

One or more second contact devices 105 (of which two are seen) are arranged such that the plunger 109 can force them to close a second conductive connection between the inner connector 108 and the outer connector 107, and thus between the first terminal 102 and the second terminal 103.

The plunger 109 is displaceable along a first direction 118 and can be guided in such a movement by surrounding structure, such as the inner connector 108. The plunger 109 may also be substantially annular, which, when the inner conductor 108 is annular, strictly defines the movement of the plunger 109 along the first direction 118. The plunger 109 is movable from an initial state shown in FIG. 1A, via a first state shown in FIG. 1B, to a second state shown in FIG. 1C. Optionally, the plunger comprises a front section and a back section, detachable from each other.

In the initial state shown in FIG. 1A, first terminal 102 and second terminal 103 are conductively separated. Hence, in this state, there is no conductive path between the first terminal 102 and the second terminal 103, corresponding to a normal operational state where a protected electrical device, connected in parallel between the first terminal 102 and an the second terminal 103, is not bypassed. In the state shown here, the plunger 109 is located such that neither the first contact device(s) 104 nor the second contact device(s) 105 form a conductive connection between the inner conductor 108 and the outer conductor 107. Furthermore, there is a physical separation in which air (or other fluid) is provided between the inner conductor 108 and the outer conductor 107 to conductively separate the inner conductor 108 and the outer conductor 107.

An actuator 115, here in the form of a pyrotechnic device, is triggered when the bypass device 100 is to be activated. The actuator 115 is thus used when the plunger 109 is to be moved to thereby achieve a conductive path through the bypass device 100. The actuator can be any suitable device which can be controlled to move the plunger 109 along the first path 118. For instance, the actuator could also be implemented using a spring, electromagnetic device, etc.

In the first state shown in FIG. 1B, the plunger 109 has moved so far that it mechanically forces the first contact device(s) 104 to close a first conductive connection between the first terminal 102 and the second terminal 103. More specifically, this is achieved by the first contact device(s) 104 forming a conductive connection between the inner conductor 108 and the outer conductor 107. The transition from the initial state to the first state occurs when the first conductive connection is established. In the first state, the second contact device(s) 105 is in a state where it does not form part of a conductive connection between the first terminal and the second terminal 103. Hence, the initial energy transfer, which may involve arcing, between the first terminal and the second terminal 103 occurs via the first contact device(s) 104.

However, the plunger 109 continues to move due to its kinetic energy provided by the actuator 115. Once the plunger 109 has moved so far that it mechanically forces the second contact device(s) 105 to close a second conductive connection between the first terminal 102 and the second terminal 103, the second state is assumed, as shown in FIG. 1C. In the second state, the second contact device(s) 105 causes a conductive connection between the inner conductor 108 and the outer conductor 107 to achieve the second conductive connection. In the second state, the first conductive connection is optionally still active. In the second state, the plunger is optionally fixed to surrounding structures, e.g. by means of wedging, to thereby keep the second contact device(s) 105 in a state where the second conductive connection is maintained.

It is to be noted that the FIGS. 1A-C are only schematic to better explain the functionality of the bypass switch and the geometrical structure of the components shown can vary significantly from what is shown.

Figure 2A:
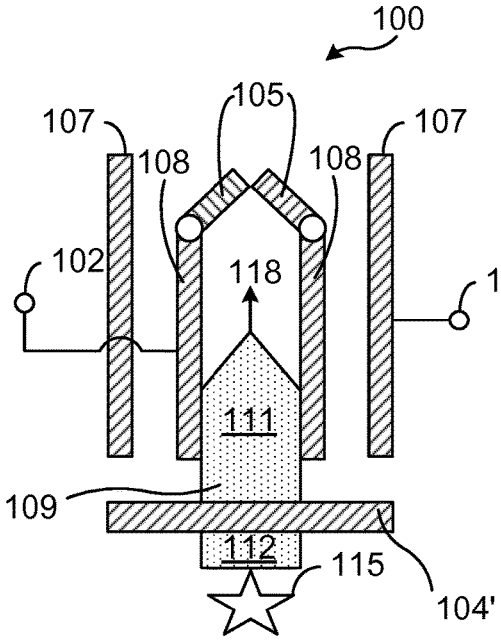
FIGS. 2A-C are schematic diagrams illustrating various states of a bypass switch according to one embodiment.
Figure 2B:
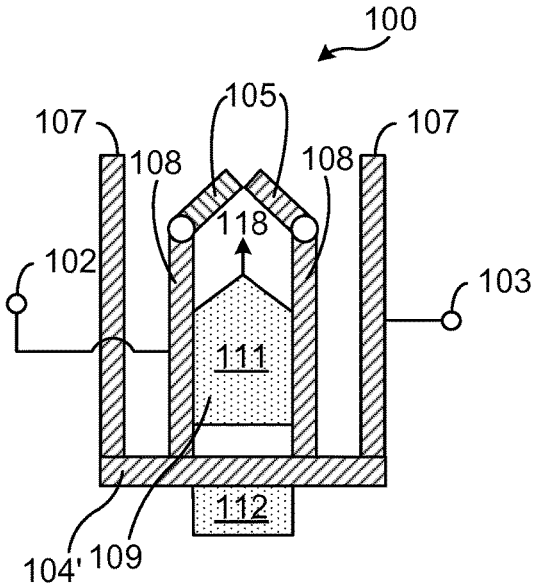
Figure 2C:
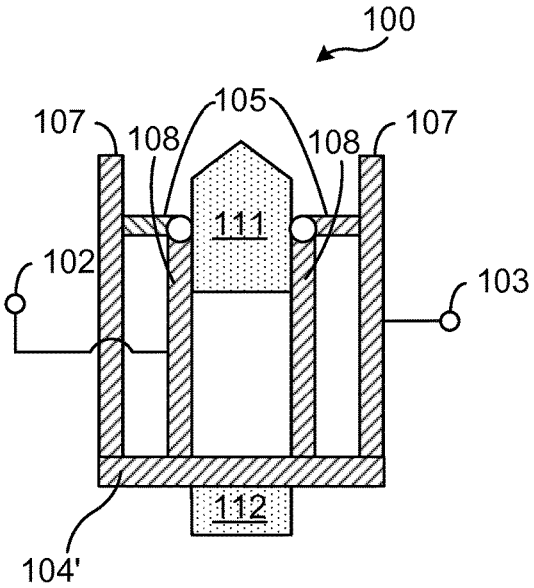

FIGS. 2A-C are schematic diagrams illustrating various states of a bypass switch 100 according to one embodiment. FIG. 2A illustrates an initial state, FIG. 2B illustrates a first state and FIG. 2C illustrates a second state of the bypass switch 100. The figures represent a sectional view through the bypass switch 100. The bypass switch 100 can e.g. be of an annular structure.

In this embodiment, the first contact device 104' is attached to the plunger 109 such that when the plunger 109 moves along the first direction, the first contact device 104' closes a first conductive connection between the inner connector 108 and the outer connector 107, and thus between the first terminal 102 and the second terminal 103.

The plunger here comprises a front section 111, an optional back section 112 and the first contact device 104' attached to the front section 111 and the optional back section 112. The front section 111 is detachably connected to the first contact device 104'.

Since the front section in and first contact device 104' are detachable from each other, when the first contact device 104' forms a connection between the inner conductor 108 and the outer conductor 107 and is prevented from moving further along the first direction 118, the front section 111 can continue movement along the first direction 118, detaching from the first contact device 104'. The detachable connection can be any mechanical connection which can be released due to the kinetic energy of the first conductive section, when the first contact device 104' stops.

The first contact device 104' is made from conductive material.

The plunger 109 is movable from an initial state shown in FIG. 2A, via a first state shown in FIG. 2B, to a second state shown in FIG. 2C.

In the initial state shown in FIG. 2A, first terminal 102 and second terminal 103 are conductively separated. Hence, in this state, there is no conductive path between the first terminal 102 and the second terminal 103, corresponding to a normal operational state where a protected electrical device, connected in parallel between the first terminal 102 and an the second terminal 103, is not bypassed. In the state shown here, the plunger 109 is located such that neither the first contact device(s) 104 nor the second contact device(s) 105 form a conductive connection between the inner conductor 108 and the outer conductor 107. Furthermore, there is a physical separation in which air (or other fluid) is provided between the inner conductor 108 and the outer conductor 107 to conductively separate the inner conductor 108 and the outer conductor 107. The actuator 115 is triggered when the bypass device 100 is to be activated.

In the first state shown in FIG. 2B, the plunger 109 has moved so far that it causes the first contact device 104' to close a first conductive connection between the first terminal 102 and the second terminal 103. More specifically, this is achieved by the first contact device(s) 104 forming a conductive connection between the inner conductor 108 and the outer conductor 107. The transition from the initial state to the first state occurs when the first conductive connection is established. In the first state, the second contact device(s) 105 is in a state where it does not form part of a conductive connection between the first terminal and the second terminal 103. Hence, the initial energy transfer, which may involve arcing, between the first terminal 102 and the second terminal 103 occurs via the first contact device(s) 104'.

However, the plunger 109 continues to move due to its kinetic energy provided by the actuator 115. The front section 111 of the plunger detached from the first contact device and continues to move along the first direction 118. Once the front section 111 of the plunger 109 has moved so far that it mechanically forces the second contact device(s) 105 to close a second conductive connection between the first terminal 102 and the second terminal 103, the second state is assumed, as shown in FIG. 2C. In the second state, the second contact device(s) 105 causes a conductive connection between the inner conductor 108 and the outer conductor 107 to achieve the second conductive connection. In the second state, the first conductive connection is optionally still active. In the second state, the plunger is optionally fixed to surrounding structures, e.g. by means of wedging, to thereby keep the second contact device(s) 105 in a state where the second conductive connection is maintained.

It is to be noted that FIGS. 2A-C are only schematic to better explain the functionality of the bypass switch and the geometrical structure of the components shown can vary significantly from what is shown.

In embodiments of FIGS. 1A-C and FIGS. 2A-C, the first state allows the first electrical contact 104, 104' to take the main electrical stress when the bypass switch 100 is triggered and is used to reduce the voltage between the two sides of the bypass switch 100, which may involve arcing.

Arcing often reduces the quality of the contacts, but since the bypass switch 100 then proceeds to the second state, the arcing is already done and the second electrical contact(s) 105 is connected without (or negligible) arcing. The second electrical contact(s) 105 is then connected without (or with negligible) arcing, providing a stable and predictable connection which can last indefinitely e.g. until the bypassed electrical device is replaced or repaired.

The same propellant force is used to close both the first (arcing) conductive path and the second (stable) conductive path, which results in a bypass switch with only one trigger to the actuator and with a low number of components and which still achieves an arcing contact followed by a stable contact. Moreover, the plunger 109 is in itself (apart from the attached first contact device 104' of FIGS. 2A-C) not part of the conductive path, and can be (but does not need to be) electrically insulating.

The dimensions of the contacts and the timing of the movement (e.g. speed when propelled by the actuator) can be configured such that sufficient energy is transferred between the two sides of the bypass switch in the first state. In other words, during transition from the initial state via the first state to the second state, the movement of the plunger 109 is sufficiently slow such that energy transferred between during the first state prevents arcing when the second state is assumed.

The bypass switch 100 can be for one time use, requiring replacement after use. Alternatively, the bypass switch can be deployed multiple times, by allowing the plunger 109 to be moved back to the initial state and replacing or preparing the actuator for another trigger.

Figure 3:
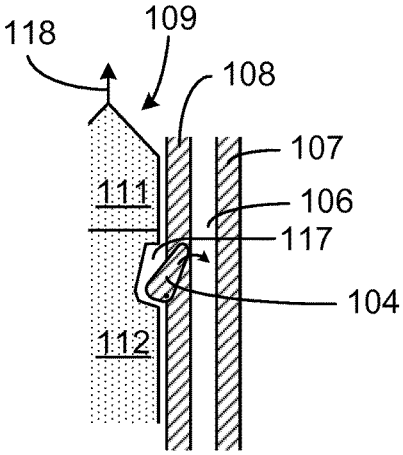
FIG. 3 is a schematic diagram illustrating an embodiment of the first contact device of FIGS. 1A-C.

FIG. 3 is a schematic diagram illustrating an embodiment of the first contact device 104 of FIGS. 1A-C. Here, the first contact device 104 is fixed to the inner conductor 108 and is pivotable from a non-conductive state to a conductive state, when forced by the plunger. The first contact device 104 is pivotably fixed in one end to the inner conductor 108 about which it can rotate. There is a corresponding recess 117 in the plunger 109, whereby the first contact device 104 is in a non-conductive (open) state in the state shown in FIG. 3. Non-conductive for the first contact device 104 here implies that the first contact device 104 does not provide a conductive contact between the inner conductor 108 and the outer conductor 107. When the plunger moves in the first direction 118, the walls of the recess 117 forces the first contact device 104 to pivot, thereby causing a conductive connection between the inner conductor 108 and the outer conductor 107.

The plunger here comprises a front section 111 and a back section 112. The front section 111 is detachably connected to the back section 112. The back wall (lower in FIG. 3) of the recess 117 is located in the back section, whereby in the first state, it is the back section 112 which mechanically forces the first contact device 104.

Since the front section 111 and back section 112 are detachable from each other, if for some reason the back section 112 becomes stuck e.g. to the first contact device 104, the front section 111 can continue movement along the first direction 118, detaching from the back section 112. The detachable connection can be any mechanical connection which can be released due to the kinetic energy of the first conductive section when the back section 112 becomes stuck.

Figure 4:
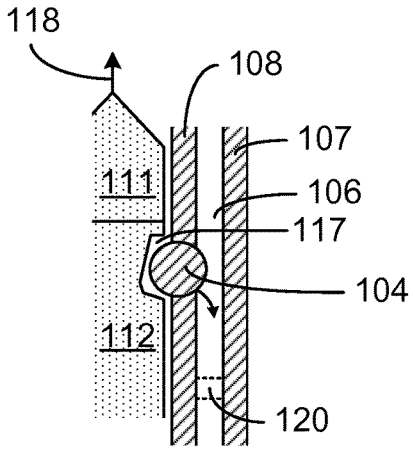
FIG. 4 is a schematic diagram illustrating an embodiment of the first contact device of FIGS. 1A-C.

FIG. 4 is a schematic diagram illustrating an embodiment of the first contact device of FIGS. 1A-C. Here, the first contact device 104 comprises a conductive ball which is displaceable to cause a transition of the first contact device 104 from a non-conductive state to a conductive state, when forced by the plunger 109. More specifically, the plunger 109 comprises a recess 117 which can house a section of the ball, as shown in FIG. 4 in the initial state. The ball is substantially spheroidal.

When the plunger moves in the first direction 118, the walls of the recess 117 forces the ball to move outwards, causing a conductive connection between the inner conductor 108 and the outer conductor 107. Optionally, there is a stopper 120 which prevents the first contact device 104 from moving outside the space between the inner conductor 108 and the outer conductor.

As in FIG. 3, the plunger here comprises a front section in and a back section 112. The front section 111 is detachably connected to the back section 112. The back wall (lower in FIG. 3) of the recess 117 is located in the back section, whereby in the first state, it is the back section 112 which mechanically forces the first contact device 104.

Figure 5A:
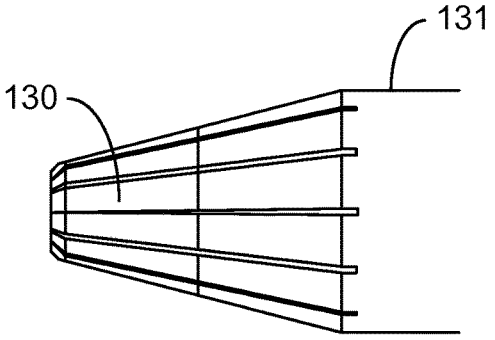
FIGS. 5A-B are schematic diagram illustrating an embodiment of the second contact device of FIGS. 1A-C in an open state and a closed state.
Figure 5B:
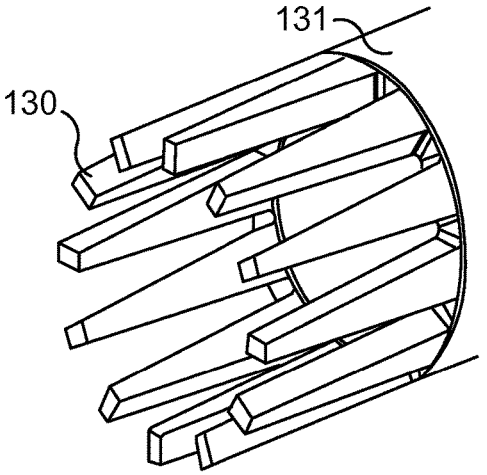

FIGS. 5A-B are schematic diagram illustrating an embodiment of the second contact device 105 of FIGS. 1A-C. FIG. 5A shows the second contact device 105 in an (electrically) open state and FIG. 5B shows the second contact device 105 an (electrically) closed state. The second movable contact comprises a fixed section 131 and a plurality of prongs 130. The prongs 130 are fixed on one end to the fixed section 131 and are free on the other end, whereby the prongs are forcible radially outwards by the plunger to close the second conductive connection.

In FIG. 5A, the prongs are close to each other, in a cone shaped position. Here, the bypass contact 100 is either in the initial state or the first state. Once the plunger (not shown) moves along the first direction 118, the plunger forces the prongs 130 outwards as seen in FIG. 5B, thereby closing the second conductive connection.

Optionally, the prongs are made of metal which bends when forced by the plunger. The prongs 130 can then also act to wedge the plunger in a fixed position in the second state.

Figure 6:
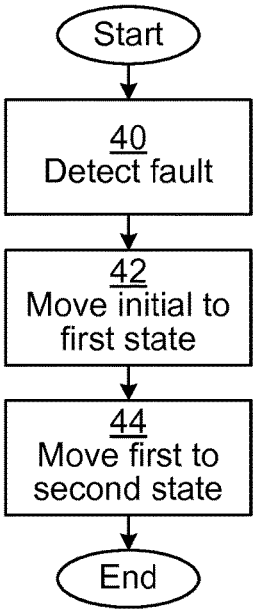
FIG. 6 is a flow chart illustrating an embodiment of a method for providing a conductive path in the bypass switch.

FIG. 6 is a flow chart illustrating a method for providing a conductive path in an embodiment of the bypass switch. The method is performed in the bypass switch.

In a detect fault step, a fault is detected in an electrical device connected across the first terminal 102 and the second terminal 103. This causes the actuator of the bypass switch to be triggered.

In a move initial to first state step 42, the plunger 109 is moved from the initial state to the first state. As described above, in the initial state, the first terminal 102 and second terminal 103 are conductively separated. Moreover, in the first state the plunger 109 mechanically forces the first contact device 104 to close a first conductive connection between the first terminal 102 and the second terminal 103.

In a move first to second state step 44, the plunger 109 is moved from the first state to a second state.

As described above, in the second state the plunger mechanically forces the second contact device 105) to close a second conductive connection between the first terminal 102) and the second terminal 103).

The move initial to first state step 42 and the move first to second state step 44 may be performed as a result of a continuous movement of the plunger.

Figure 7:
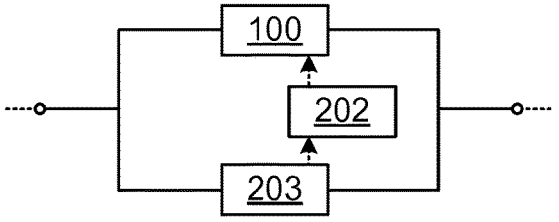
FIG. 7 is a schematic diagram illustrating a power system employing a bypass to switch.

FIG. 7 is a schematic diagram illustrating a power system 200 employing a bypass switch 100. The power system 200 comprises an electrical device 201 and a bypass switch 100 according to any of the embodiments described above. The first terminal 102 and the second terminal 103 of the bypass switch are connected across the electrical device 201. The electrical device 201 is any suitable type of electrical device which can benefit from bypassing when it fails, e.g. capacitors, solid state switches, etc.

A controller 202 is provided which, when a fault 201 is detected in the electrical device 201, sends a signal to the bypass switch 100 to provide a bypass path. The signal actuates the actuator of the bypass switch to thereby trigger a movement of the plunger as described above.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A bypass switch for providing a bypass path between a first terminal and a second terminal, the bypass switch comprising:

a first contact device;

a second contact device; and a plunger being moveable from an initial state, via a first state, to a second state, wherein in the initial state the first terminal and second terminal are conductively separated; in the first state a movement of the plunger causes the first contact device to close a first conductive connection between the first terminal and the second terminal; and in the second state the plunger mechanically forces the second contact device to close a second conductive connection between the first terminal and the second terminal, AND wherein the plunger comprises a front section and a back section, wherein the front section is detachably connected to the back section, and wherein, in the first state, it is the back section which causes the first contact device to close the first conductive connection.

2. The bypass switch according to claim 1, wherein the plunger is displaceable along a first direction to transition from the initial state, via the first state, to the second state.

3. The bypass switch according to claim 2, wherein the second contact device is located, in the first direction, in front of the first contact device.

4. The bypass switch according to claim 3, wherein the second contact device comprises a plurality of prongs which are forcible radially outwards by the plunger to close the second conductive connection.

5. The bypass switch according to claim 3, wherein the first contact device is pivotable from a non-conductive state to a conductive state, when forced by the plunger.

6. The bypass switch according to claim 2, wherein the second contact device comprises a plurality of prongs which are forcible radially outwards by the plunger to close the second conductive connection.

7. The bypass switch according to claim 2, wherein the first contact device is pivotable from a non-conductive state to a conductive state, when forced by the plunger.

8. The bypass switch according to claim 1, wherein the second contact device comprises a plurality of prongs which are forcible radially outwards by the plunger to close the second conductive connection.

9. The bypass switch according to claim 8, wherein the first contact device is pivotable from a non-conductive state to a conductive state, when forced by the plunger.

10. The bypass switch according to claim 1, wherein the first contact device is pivotable from a non-conductive state to a conductive state, when forced by the plunger.

11. The bypass switch according to claim 1, wherein the first contact device comprises a conductive ball which is displaceable to cause a transition of the first contact device from a non-conductive state to a conductive state, when forced by the plunger.

12. The bypass switch according to claim 1, wherein the first contact device is attached to the plunger in the initial state.

13. The bypass switch according to claim 1, further comprising a pyrotechnic device which, when fired, produces a shock wave to move the plunger from the initial state, via the first state to the second state.

14. The bypass switch according to claim 1, further comprising a spring which, when released causes the plunger to move from the initial state, via the first state to the second state.

15. The bypass switch according to claim 1, wherein, during transition from the initial state via the first state to the second state, the movement of the plunger is sufficiently slow such that energy transferred over the first conductive connection during the first state prevents arcing to the second contact device when the second state is assumed.

16. The bypass switch according to claim 1, wherein the plunger is electrically insulating.

17. A power system comprising:

an electrical device; and the bypass switch according to claim 1, wherein the first terminal and the second terminal of the bypass switch, are connected across the electrical device.

18. A method for providing a conductive path between a first terminal and a second terminal, the method being performed in a bypass switch comprising a first contact device; a second contact device; and a plunger, wherein the method comprises the steps of:

moving the plunger from an initial state to a first state wherein in the initial state the first terminal and second terminal are conductively separated, and in the first state the plunger causes the first contact device to close a first conductive connection between the first terminal and the second terminal; and moving the plunger from the first state to a second state, wherein in the second state the plunger mechanically forces the second contact device to close a second conductive connection between the first terminal and the second terminal, wherein the plunger comprises a front section and a back section, wherein the front section is detachably connected to the back section, and wherein, in the first state, it is the back section which causes the first contact device to close the first conductive connection.

19. The method according to claim 18, further comprising the step of:

detecting a fault in an electrical device connected across the first terminal and the second terminal.

20. The method according to claim 18, wherein the steps of moving from the initial state to the first state and moving from the first state to the second state are performed as a result of a continuous movement of the plunger.

* * * * *